US008466607B2

(12) United States Patent
Aochi et al.

(10) Patent No.: US 8,466,607 B2
(45) Date of Patent: Jun. 18, 2013

(54) SPARK PLUG FOR INTERNAL-COMBUSTION ENGINES

(75) Inventors: Takanobu Aochi, Nishio (JP); Shinichi Okabe, Aichi-ken (JP); Takayuki Inohara, Okazaki (JP); Masamichi Shibata, Toyota (JP)

(73) Assignees: Nippon Soken, Inc., Nishio (JP); Denso Corporation, Kariya (JP)

( * ) Notice: Subject to any disclaimer, the term of this patent is extended or adjusted under 35 U.S.C. 154(b) by 0 days.

(21) Appl. No.: 13/482,079

(22) Filed: May 29, 2012

(65) Prior Publication Data

US 2012/0299458 A1 Nov. 29, 2012

(30) Foreign Application Priority Data

May 27, 2011 (JP) ..... 2011-118979

(51) Int. Cl.
*H01T 13/02* (2006.01)

(52) U.S. Cl.
USPC ..... 313/120; 313/141

(58) Field of Classification Search
None
See application file for complete search history.

(56) References Cited

U.S. PATENT DOCUMENTS

| | | | | |
|---|---|---|---|---|
| 5,280,214 | A * | 1/1994 | Johnson | 313/139 |
| 8,164,243 | B2 * | 4/2012 | Nunome et al. | 313/141 |
| 2006/0163992 | A1 * | 7/2006 | Kanao et al. | 313/141 |
| 2008/0092839 | A1 | 4/2008 | Hanashi et al. | |

FOREIGN PATENT DOCUMENTS

| | | |
|---|---|---|
| JP | H09-148045 | 6/1997 |
| JP | H09-148054 | 6/1997 |
| JP | P2008-108479 A | 5/2008 |
| JP | P4465296 | 2/2010 |

* cited by examiner

*Primary Examiner* — Ashok Patel
(74) *Attorney, Agent, or Firm* — Nixon & Vanderhye PC

(57) ABSTRACT

A spark plug for internal-combustion engines includes a housing, an insulator, a center electrode, and an earth electrode. A gas guiding sections equipped with slopes that slope inwardly as they approach toward a tip side from a circumference surface of the housing and guide surfaces that are disposed on both sides in a circumferential direction of the slopes are formed in a tip part of the housing. The gas guiding sections are formed in the circumferential direction within a 90-degree range measured relative to the center of the earth joint section, which is a junction of the housing and the earth electrode, in the circumferential direction. When the spark plug is mounted to the engine, it is constituted so that the gas guiding sections are projected into a combustion chamber.

8 Claims, 10 Drawing Sheets

SPARK PLUG FOR INTERNAL-COMBUSTION ENGINES

CROSS-REFERENCE TO RELATED APPLICATION

This application is based on and claims the benefit of priority from earlier Japanese Patent Application No. 2011-118979 filed May 27, 2011, the description of which is incorporated herein by reference.

TECHNICAL FIELD

The present disclosure relates to a spark plug for internal-combustion engines used for an engine of an automobile.

BACKGROUND

A spark plug used as an ignition means in internal-combustion engines (hereafter, simplified to the engines) such as an engine of an automobile, there is a spark plug provided with a spark discharge gap formed by a center electrode and an earth electrode facing in an axial direction.

The spark plug makes the spark discharge gap generates an electric discharge, and ignites a fuel-air mixture in a combustion chamber by the electric discharge.

Here, a gas flow of fuel-air mixture, such as a swirl flow or a tumble flow, is formed in the combustion chamber, and ignition performance can be secured when the gas flow flows moderately at the spark discharge gap.

However, a part of the earth electrodes joined to a tip part of a housing may be disposed at an upstream side of the spark discharge gap in the gas flow depending on the mounting position of the spark plug to the engine.

In this case, the gas flow in the combustion chamber is interrupted by the earth electrode, and there is a possibility that the gas flow near the spark discharge gap may stagnate.

As a result, there is a possibility that the ignition performance of the spark plug may fall.

That is, there is a possibility that a problem may arise that the ignition performance of the spark plug varies depending on the mounting position to the engine.

Although many engines employ lean combustion especially in recent years, there is a possibility that combustion stability may fall depending on the mounting position of the spark plug in such an engine.

Moreover, it is difficult to control the mounting position of the spark plug to the engine, i.e., the position of the earth electrode in a circumferential direction.

This is because the mounting position changes with a form of a screw for mounting in the housing, a degree of tightening the spark plug to the engine at the time of mounting, etc.

Then, in order to suppress blocking of the gas flow by the earth electrode, a composition with a process of opening a hole in the earth electrode, or a composition of joining an earth electrode to a housing by a plurality of thin tabular members are disclosed (refer to Japanese Patent Application Laid-Open Publication No. 9-148045).

Moreover, in order to stabilize a direction of the tumble flow in a combustion chamber, a composition that provides an inclined circumference surface section in a tip part of a housing is also disclosed (refer to Japanese Patent Application Laid-Open Publication No. 2008-108479).

However, with the earth electrode having a hole un the earth electrode as disclosed in '045, there is a possibility of causing strength reduction of the earth electrode.

Moreover, if the earth electrode is thickly formed in order to prevent such strength reduction, it becomes easy to block the gas flow of fuel-air mixture after all.

Similarly, with the inclined circumference surface section in a tip part of a housing as disclosed in '479, manufacturing steps increases due to the shape of the earth electrode being complicated, and the manufacturing cost becomes high.

Moreover, the problem that the earth electrode disposed at the upstream side of the gas flow relative to the spark discharge gap blocks the gas flow is unsolvable with the composition in '479, because it does not specify the formation position of the inclined circumference surface section.

SUMMARY

An embodiment provides a spark plug for internal-combustion engines with a simple composition that can secure a stable ignition performance without concerning a mounting position relative to the engines.

In a spark plug for internal-combustion engines according to a first aspect, the spark plug includes a cylindrical housing, a cylindrical insulator held inside the housing, a center electrode held inside the insulator so that a tip part of the center electrode project, and an earth electrode connected to the housing form a spark discharge gap between itself and the center electrodes.

A gas guiding section is formed in a circumferential direction within a 90-degree range measured relative to a center of the earth joint section, which is a junction of the housing and the earth electrode in the circumferential direction at the housing.

The gas guiding section includes a slope that inclines toward a central axis from a circumference surface of the housing and at least one guide surface that has side wall parts continuously formed on both sides of the slope.

The spark plug has the gas guiding section formed in the circumferential direction within the 90-degree range measured relative to the center of the earth joint section in the circumferential direction at the tip part of the housing.

Therefore, ignition performance is securable even if the earth joint section is disposed at an upstream side of the spark discharge gap in a gas flow in a combustion chamber when the spark plug is mounted to the engine.

That is, when the earth joint section is disposed at the upstream side of the spark discharge gap, the gas flow that flows to near the tip part of the spark plug from the upstream side of the earth joint section can be led to the spark discharge gap by the gas guiding section.

Thereby, stagnation of the gas flow in the spark discharge gap can be prevented.

As a result, even if the earth joint section is disposed at the upstream side of the spark discharge gap, the ignition performance of the spark plug is securable.

That is, stable ignition performance can be secured without concerning any special requirement on the mounting position of the spark plug relative to the engine.

Moreover, the gas guiding section is disposed in the tip part of the housing, and it is not necessary to change the shape in particular of the earth electrode, etc.

Therefore, the strength reduction of the earth electrode does not occur, and manufacturing steps do not increase due to the shape of the earth electrode being complicated, and manufacturing cost is not increased unnecessarily.

According to the present disclosure, the spark plug for the engines with simple composition that can secure stable ignition performance without any special mounting position being required can be offered.

In the spark plug according to a second aspect, the gas guiding section is projected into a combustion chamber when the spark plug is mounted to the engines.

In the spark plug according to a third aspect, the gas guiding section is formed in a position adjoining the earth joint section.

In the spark plug according to a fourth aspect, the gas guiding section is formed in the circumferential direction within a 45-degree range measured relative to the center of the earth joint section in the circumferential direction.

In the spark plug according to a fifth aspect, wherein, the gas guiding section is formed on both sides in the circumferential direction of the earth joint section.

In the spark plug according to a sixth aspect, wherein, the gas guiding section is formed by projecting a part of the housing outward from its tip side.

In the spark plug according to a seventh aspect, wherein, a tip of the gas guiding section is disposed away from the tip of the insulator and towards the base end side.

In the spark plug according to an eighth aspect, wherein, the tip of the gas guiding section is disposed 0.5 mm or more away from the tip of the insulator and towards the base end side.

DETAILED DESCRIPTION OF THE PREFERRED EMBODIMENTS

First Embodiment

Figure 1:
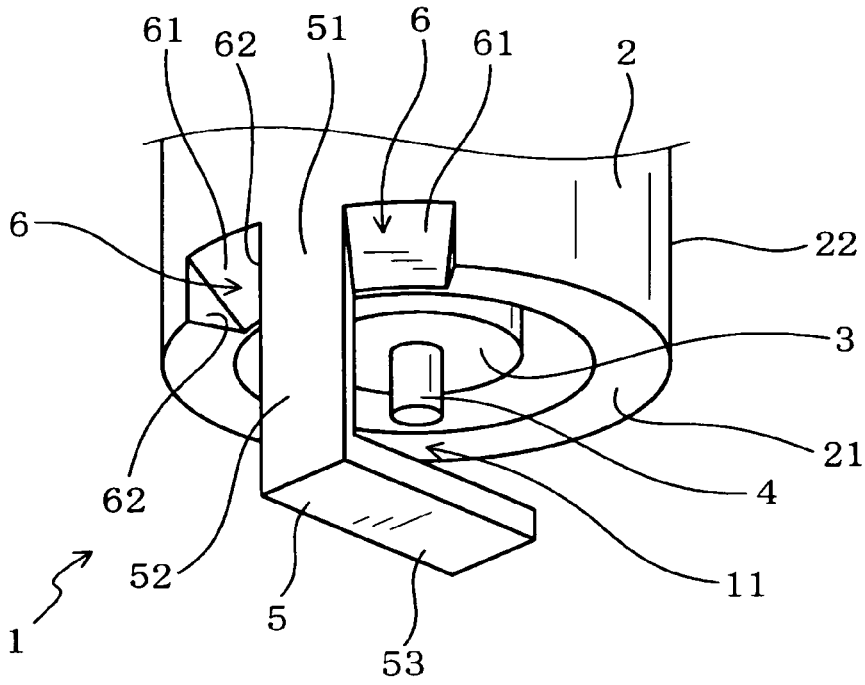
FIG. 1 shows a perspective view of a tip portion of a spark plug for internal-combustion engines (hereafter, simplified to the engines) in a first embodiment.

With reference to FIG. 1-FIG. 5, hereinafter will be described an embodiment regarding a spark plug for internal-combustion engines (hereafter, simplified to engines) of the present disclosure.

In a spark plug 1 of the present disclosure, a side inserted into a combustion chamber of an engine is defined as a tip side, and an opposite side is defined as a base end side, for convenience.

As shown in the FIG. 1-FIG. 4, the spark plug 1 of the present embodiment has a cylindrical housing 2, a cylindrical insulator 3 held inside the housing 2, a center electrode 4 held inside the insulator 3 so that a tip part of the center electrode project outwardly, and an earth electrode 5 connected to the housing 2 that forms a spark discharge gap 11 between the center electrodes 4.

Gas guiding sections 6 are formed in a tip part 21 of the housing 2.

The gas guiding sections 6 are equipped with slopes 61 that slope inwardly as they approach toward the tip side from a circumference surface 22 of the housing 2, and guide surfaces 62 that are disposed on both sides in a circumferential direction of the slopes 61.

Assuming that a junction of the housing 2 and the earth electrode 5 is an earth electrode joint section 51 (hereafter, simplified to the earth joint section), the gas guiding sections 6 are formed in the circumferential direction within a 90-degree range measured relative to a center of the earth joint section 51 in the circumferential direction.

Tips of the gas guiding sections 6 are disposed towards the base end side from a center of the spark discharge gap 11 in an axial direction.

Figure 5:
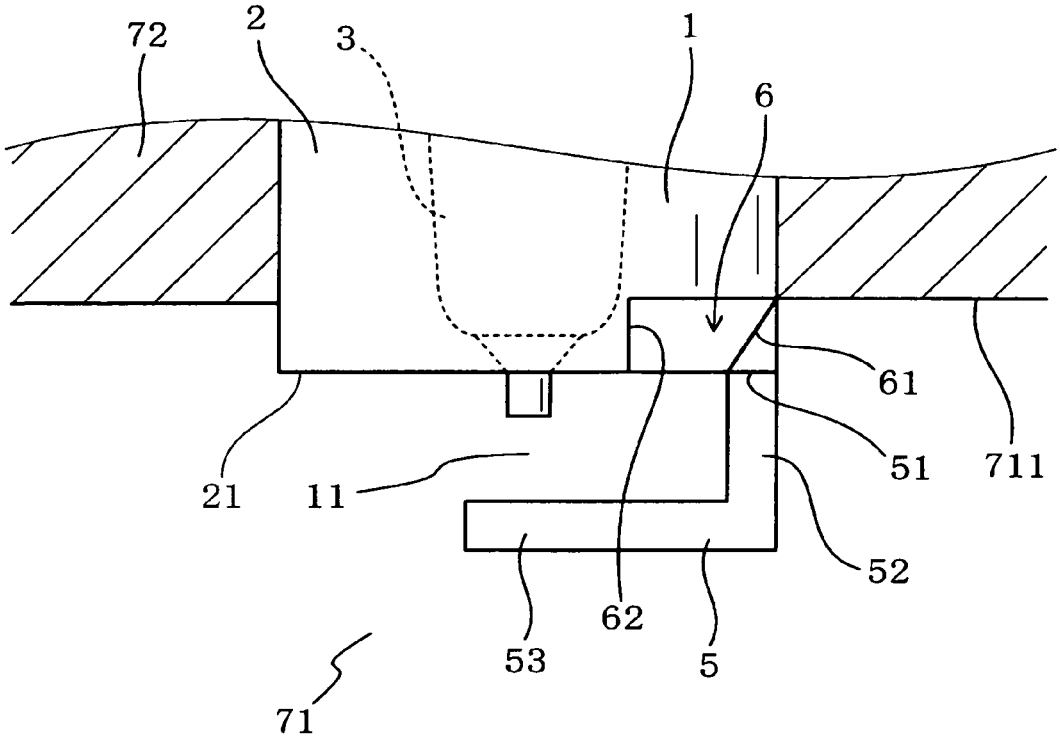
FIG. 5 shows the side view of the tip part of the spark plug attached to the engine in the first embodiment.

In addition, as shown in FIG. 5, when the spark plug 1 is mounted to the engine, the gas guiding sections 6 are projected into a combustion chamber 71.

Figure 3:
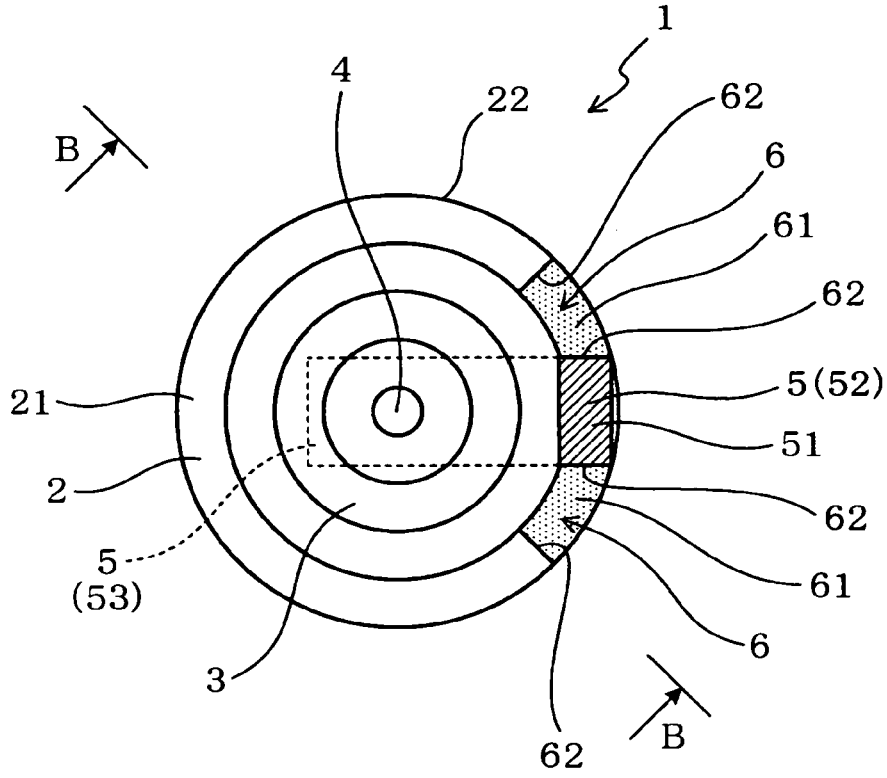
FIG. 3 shows a sectional view taken along a line A-A of FIG. 2.
Figure 4:
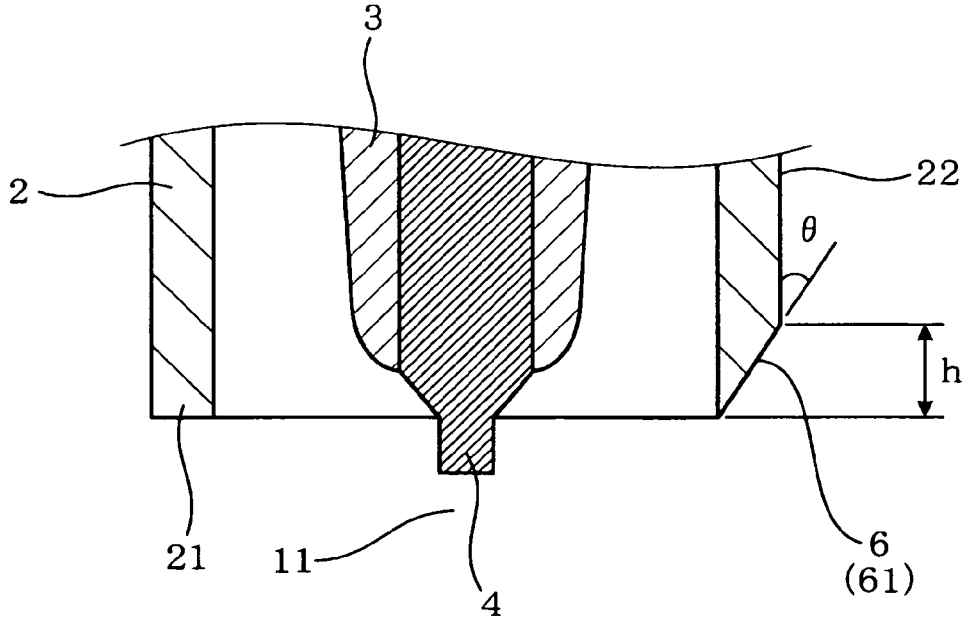
FIG. 4 shows a sectional view taken along a line B-B of FIG. 3.

Moreover, as shown in FIG. 1 and FIG. 3, the gas guiding sections 6 are formed in positions adjoining the earth joint section 51.

Further, the gas guiding sections 6 are formed on both sides in the circumferential direction of the earth joint section 51.

That is, the gas guiding sections 6 are formed over the predetermined range in the circumferential direction from both sides of the earth joint section 51 in the circumferential direction.

In the present embodiment, the gas guiding sections 6 are formed in the circumferential direction from both sides of the earth joint section 51 in the circumferential direction within a 45-degree range measured relative to the center of the earth joint section 51 in the circumferential direction.

Figure 2:
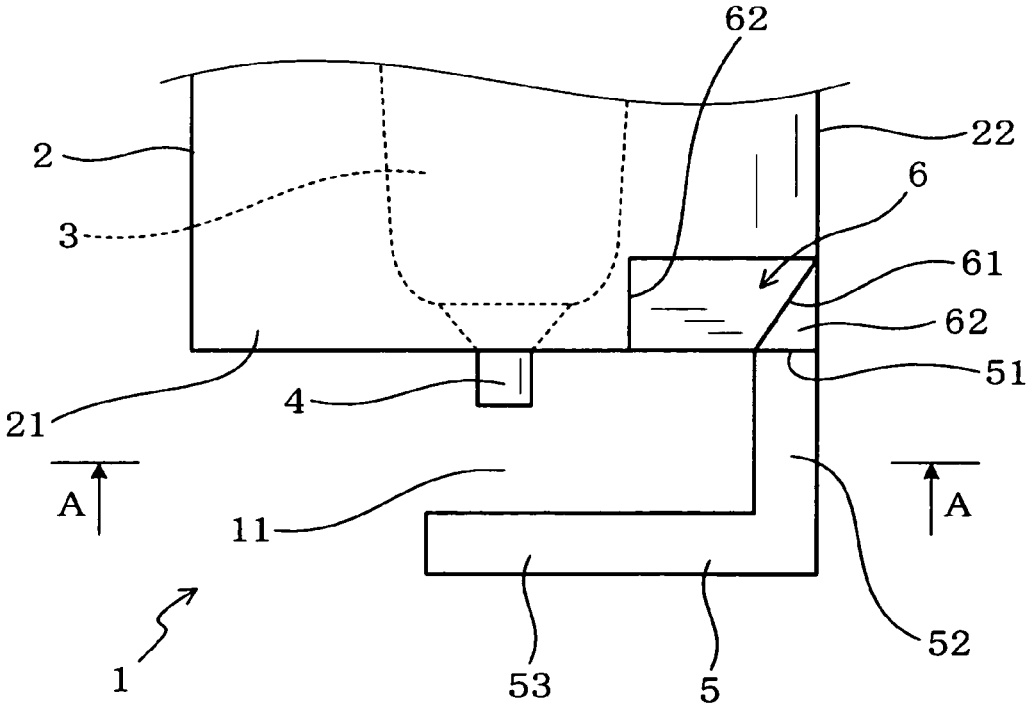
FIG. 2 shows a side view of the tip part of the spark plug for the engines in the first embodiment.

As shown in FIG. 1 and FIG. 2, the earth electrode 5 is composed of a standing portion 52 that extends from the tip part 21 of the housing 2 toward the tip side, and a sideways portion 53 bent from the tip of the standing portion 52 toward a center in a radial direction of the housing 2.

The sideways portion 53 faces the tip part of the center electrode 4 in an axial direction of the spark plug 1, and a spark discharge gap 11 is formed therebetween.

Moreover, the earth electrode 5 is joined to the tip part 21 of the housing 2 at a base end part of the standing portion 52, and constitutes the earth joint section 51.

As shown in FIG. 3, one of the guide surfaces 62 in the gas guiding sections 6 is constituted by a side surface of the standing portion 52 in the earth electrode 5.

Moreover, the other guide surfaces 62 in the gas guiding sections 6 are formed in a 45-degree position in the circumferential direction from the center of the earth joint section 51.

As for the slopes 61 in the gas guiding sections 6, an inclination angle relative to the axial direction of the spark plug 1, i.e., the inclination angle θ relative to the circumference surface 22 is 35 degrees.

Moreover, the length h of the gas guiding sections 6 in the axial direction of the spark plug 1 is 2 mm.

In addition, the diameter of the housing 2 is 12 mm, and thickness in the tip part 21 of the housing 2 is 1.45 mm.

Further, the width of the earth electrode 5 is 2.6 mm, and its thickness is 1.3 mm.

Furthermore, the tip of the center electrode 4 is projected 2 mm in the axial direction from the tip of the housing 2.

Moreover, the spark discharge gap 11 is 1.1 mm.

The tip part of the center electrode 4 is made of precious-metals chip including iridium.

Moreover, the housing 2 and the earth electrode 5 including nickel alloys.

In the present embodiment, the tip part of the insulator 3 is disposed about 0.5 mm away from the tip of the housing 2 and towards the base end side.

However, it is not limited particularly, but the tip part of the insulator 3 may be disposed in the base end side from the tip part of the housing 2, as a fourth embodiment (FIG. 10) mentioned later, or may be in the position equivalent to the tip part of the housing 2 in the axial direction.

Moreover, in the present embodiment, the tip of the housing 2 as well as the tip of the gas guiding sections 6 is disposed in the base end side from the tip of the center electrode 4.

Further, as shown in FIG. 5, in the state where the spark plug 1 is mounted to the engine (engine head 72), the tip portion 21 of the housing 2 is projected into the combustion chamber 71, and the gas guiding sections 6 also project into the combustion chamber 71.

Here, the base ends of the gas guiding sections 6 are disposed in a substantially equivalent position as a wall surface 711 of the combustion chamber 71.

In addition, the spark plug 1 of the present embodiment is used for the engine for the vehicle, such as an automobile.

Next, functions and effects of the present embodiment are explained.

The spark plug 1 has the gas guiding sections 6 formed in the circumferential direction within a 90-degree range measured relative to a center of the earth joint section 51 in the circumferential direction at the tip part 21 of the housing 2.

Therefore, ignition performance is securable even if the earth joint section 51 (standing portion 52 of the earth electrode 5) is disposed at the upstream side of the spark discharge gap 11 in the gas flow in the combustion chamber 71 in the state where the spark plug 1 is mounted to the engine (engine head 72), as shown in FIG. 5.

That is, when the earth joint section 51 is disposed at the upstream side of the spark discharge gap 11, the gas flow that flows to near the tip part of the spark plug 1 from the upstream side of the earth joint section 51 can be led to the spark discharge gap 11 by the gas guiding sections 6.

Thereby, stagnation of the gas flow in the spark discharge gap 11 can be prevented.

As a result, even if the earth joint section 51 is disposed at the upstream side of the spark discharge gap 11, the ignitionability of the spark plug 1 is securable.

That is, stable ignition performance can be secured without restrictions on the mounting position of the spark plug 1 relative to the engine (engine head 72).

Moreover, the gas guiding sections 6 are disposed in the tip part 21 of the housing 2, and it is not necessary to change the shape in particular of the earth electrode 5, etc.

Therefore, weakening of the earth electrode 5 does not occur, and manufacturing steps do not increase due to the shape of the earth electrode 5 being complicated, or a manufacturing cost does not become high.

Moreover, the gas guiding sections 6 are formed adjoining the earth joint section 51, and are formed in the circumferential direction within the 45-degree range measured relative to the center of the earth joint section 51 in the circumferential direction.

Thereby, when the earth joint section 51 is disposed at the upstream side of the gas flow relative to the spark discharge gap 11, the gas flow can be more efficiently led to the spark discharge gap 11.

Moreover, the gas guiding sections 6 are formed on both sides in the circumferential direction of the earth joint section 51.

Thereby, it becomes possible to lead the gas flow to the spark discharge gap 11 from both sides of the standing portion 52 in the earth electrode 5, and it can form the gas flow in the spark discharge gap 11 more reliably.

Moreover, as for the slopes 61 in the gas guiding sections 6, it is desirable that the inclination angle relative to the axial direction of the spark plug 1, i.e., the inclination angle θ relative to the circumference surface 22 is not less than 20 degrees.

In this case, it becomes easy to lead the gas flow to the spark discharge gap 11.

Moreover, it is desirable that the length of the gas guiding sections 6 in the axial direction of the spark plug 1 is 1 mm or more.

In this case, the effect of the gas guiding sections 6 can fully be demonstrated.

According to the present embodiment, the spark plug for the engines with simple composition that can secure stable ignition performance without restricting the mounting position relative to the engine can be offered.

Second Embodiment

It should be appreciated that, in the second embodiment and the subsequent modifications, the components identical with or similar to those in the first embodiment are given the same reference numerals for the sake of omitting explanation.

Figure 6:
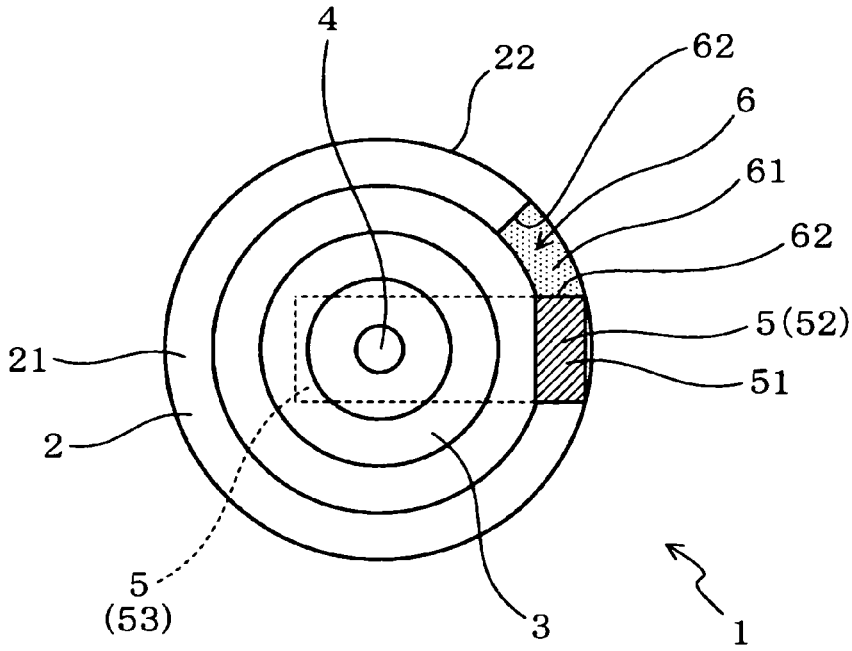
FIG. 6 shows a plane view of a spark plug seen from an axial direction in a second embodiment.

The second embodiment is an example in which the gas guiding section 6 is formed only to one position, as shown in FIG. 6.

The gas guiding sections 6 is disposed adjoining the one side of the earth joint section 51 in the circumferential direction.

The rest of the composition is the same as that of the first embodiment, and the same function and effect as the first embodiment can be obtained in the present embodiment.

Third Embodiment

Figure 7:
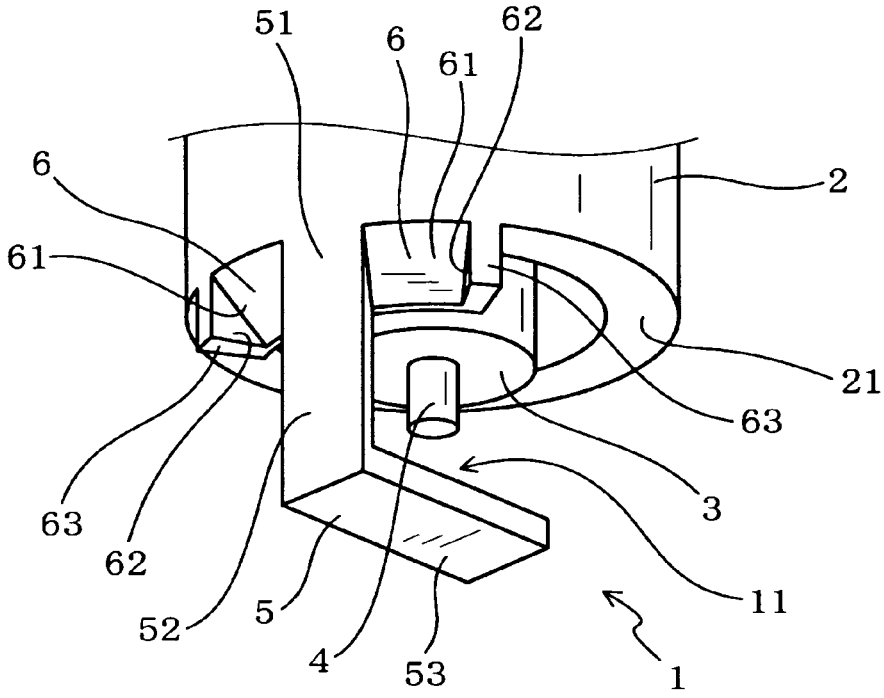
FIG. 7 shows a perspective view of a tip part of a spark plug for engines in a third embodiment.
Figure 8:
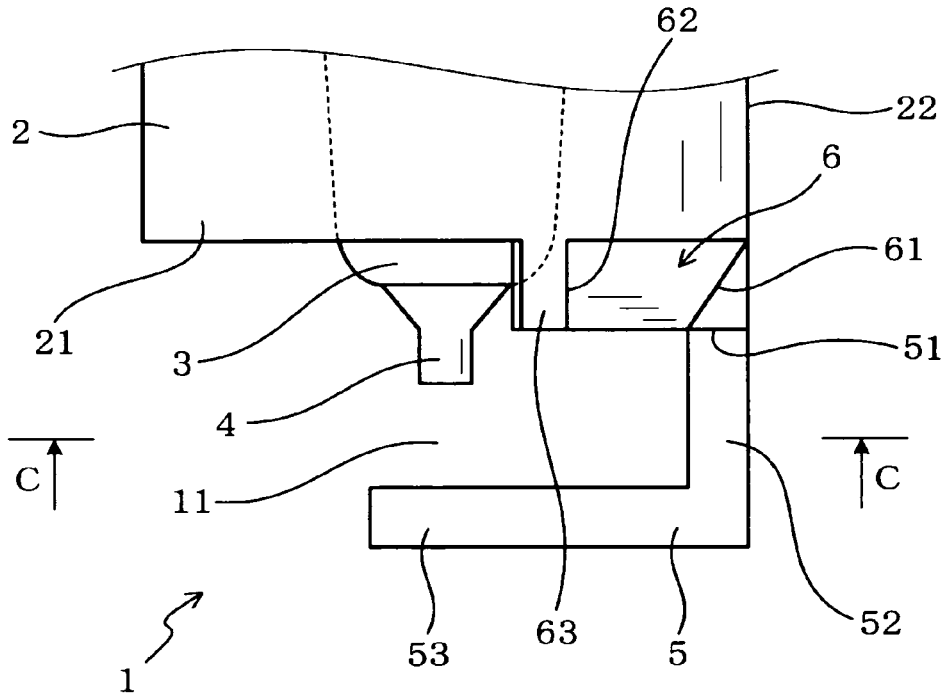
FIG. 8 shows a side view of the tip part of the spark plug for engines in the third embodiment.
Figure 9:
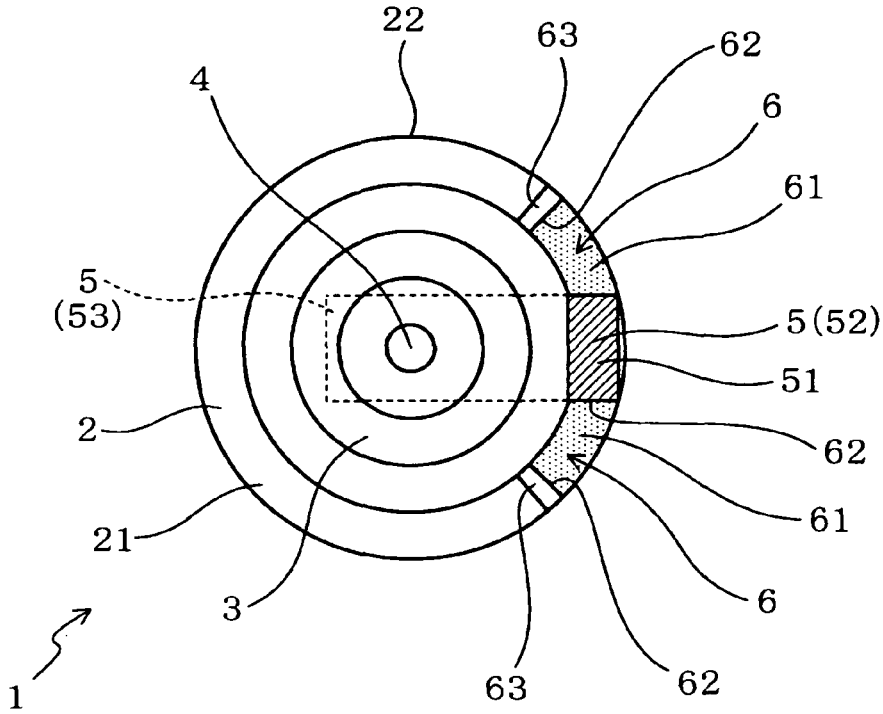
FIG. 9 shows a sectional view taken along a line C-C of FIG. 8.

The third embodiment is an example in which the gas guiding sections 6 are formed by projecting parts of the housing 2 outward from its tip side, as shown in FIG. 7-FIG. 9.

That is, the parts that adjoin the earth joint section 51 in the tip part 21 of the housing 2 are projected to the tip side more than other parts in the spark plug 1 of the present embodiment.

Then, side wall parts 63 for forming the slopes 61 and the guide surfaces 62 are formed in the projected parts.

That is, surfaces if the slopes 61 sides in the side wall parts 63 become the guide surfaces 62 in the gas guiding sections 6.

The other guide surfaces 62 in the gas guiding sections 6 are constituted by the side of the standing portion 52 of the earth electrode 5 as the first embodiment.

Moreover, at portions other than the gas guiding sections 6, the insulator 3 is projected towards the tip side from the housing 2 in the present embodiment.

Specifically, the axial position of the tip of the housing 2 in the portions other than the gas guiding sections 6 correspond with the base end of the gas guiding sections 6.

Moreover, the tip of the housing 2 in the portions other than gas guiding sections 6, and the base end of the gas guiding sections 6 are disposed in positions equivalent to the surface of the wall 711 of the combustion chamber 71 when the spark plug 1 is mounted to the engine.

The rest of the composition is the same as that of the first embodiment.

Since the tip of the housing 2 can be kept away from the spark discharge gap 11 in the portions other than the gas guiding sections 6, it becomes easy to prevent horizontal spark-spreading between the center electrode 4 and the tip part 21 of the housing 2 in the present embodiment.

In addition, the same function and effect as the first embodiment can be obtained in the present embodiment.

Fourth Embodiment

Figure 10:
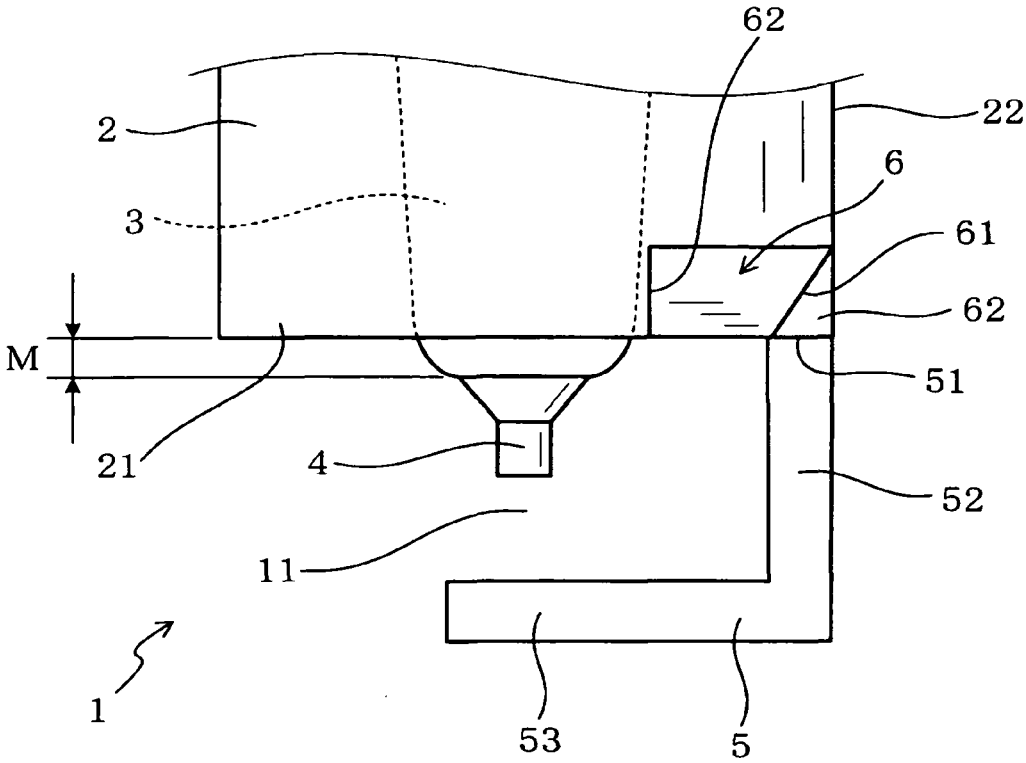
FIG. 10 shows a side view of a tip portion of a spark plug for engines in a fourth embodiment.

The fourth embodiment is an example of the spark plug 1 in which the tip of the gas guiding sections 6 is disposed away from the tip of the insulator 3 and towards the base end side, as shown in FIG. 10.

Especially, it is desirable the tip of the gas guiding sections 6 is disposed 0.5 mm or more away from the tip of the insulator and towards the base end side 3.

That is, it is desirable that a distance M in the axial direction between the tips of the gas guiding sections 6 and the tip of the insulator 3 in FIG. 10 is 0.5 mm or more.

The rest of the composition is the same as that of the first embodiment.

The gas flow can be efficiently led by the gas guiding sections to the spark discharge gap in the present embodiment.

In addition, the same function and effect as the first embodiment can be obtained in the present embodiment.

Fifth Embodiment

Figure 11:
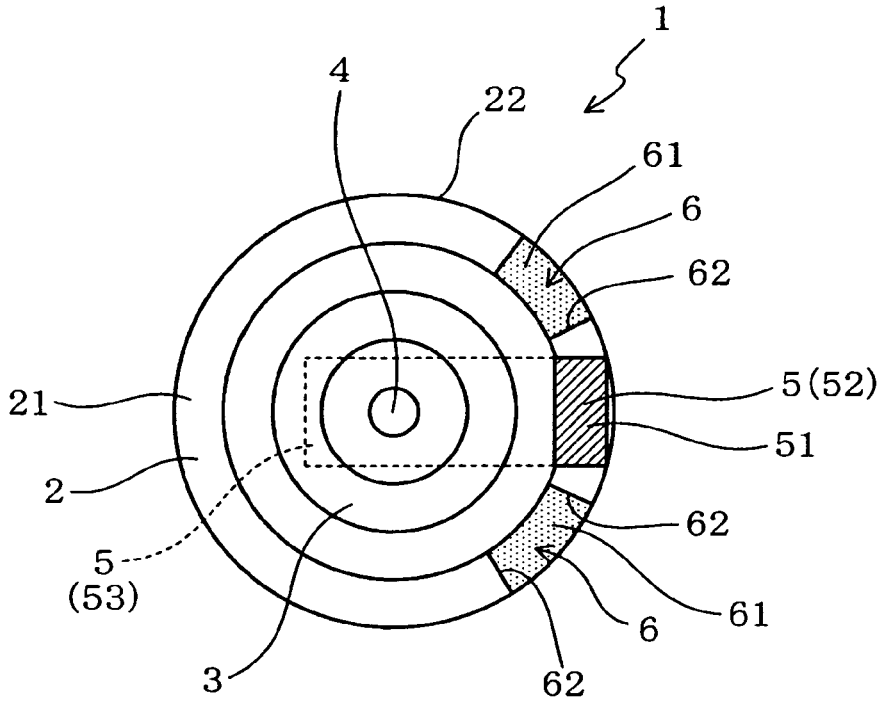
FIG. 11 shows a plane view of a spark plug seen from an axial direction in a fifth embodiment.

The fifth embodiment is an example in which the gas guiding sections 6 are formed away from the earth joint section 51, as shown in FIG. 11.

That is, although the examples of disposing the gas guiding sections 6 (slopes 61) adjoined to the earth joint section 51 are shown in the first to fourth embodiments, the gas guiding sections 6 may be disposed away from the earth joint section 51 like the present embodiment.

The rest of the composition is the same as that of the first embodiment, and the same function and effect as the first embodiment can be obtained in the present embodiment.

Comparative Example

Figure 12:
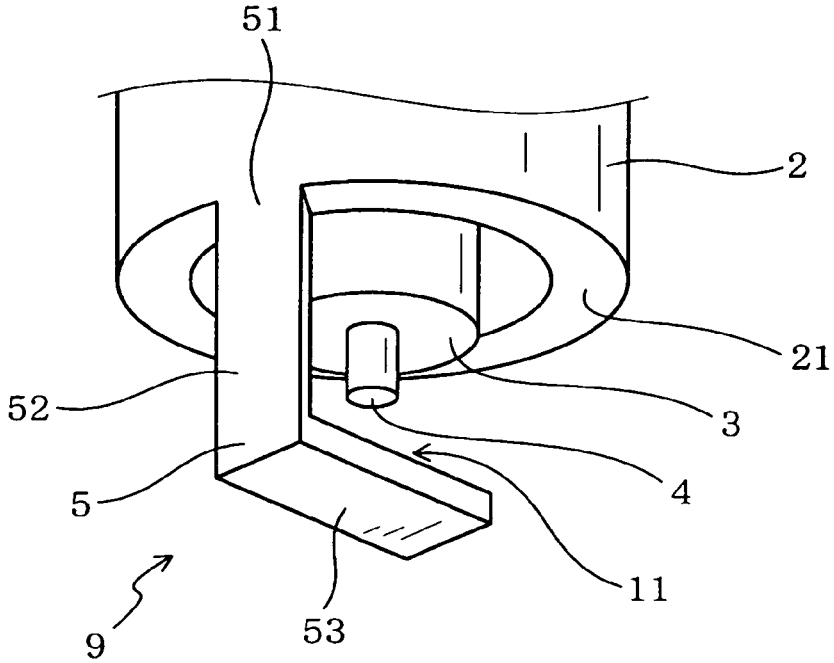
FIG. 12 shows a perspective view of a tip part of a spark plug for engines in a comparative example.

The comparative example is an example of a conventional spark plug 9 that has no gas guiding sections 6, as shown in FIG. 12 and FIG. 13.

A tip of an insulator 3 in the spark plug 9 of the comparative example is projected outwardly from a tip of a housing 2. The rest of the composition is the same as that of the first embodiment.

Figure 13A:
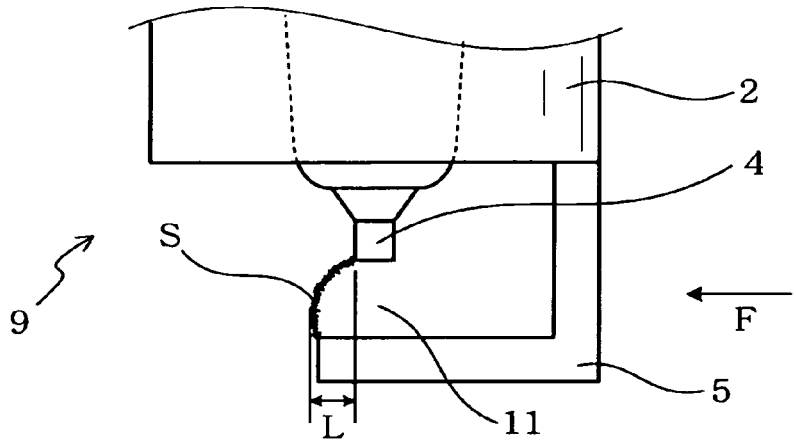
FIG. 13A shows a diagram of electric discharge when a standing portion of an earth electrode is disposed in an upstream side in the comparative example.
Figure 13B:
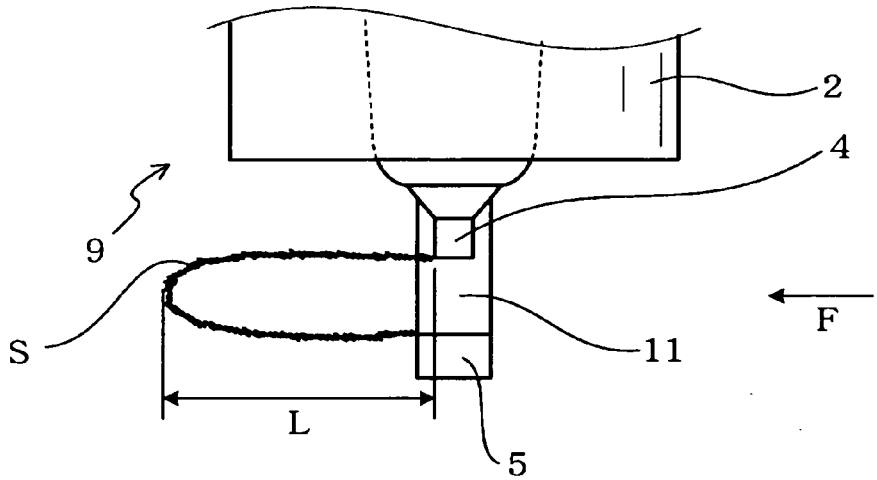
FIG. 13B shows a diagram of electric discharge when the standing portion of the earth electrode is disposed to a position intersecting perpendicularly with a gas flow in the comparative example.
Figure 13C:
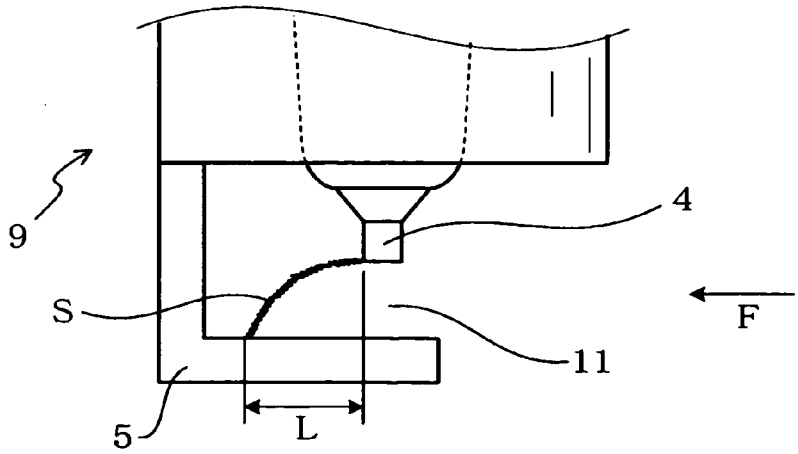
FIG. 13C shows the diagram of electric discharge when the standing portion of the earth electrode is disposed in a downstream side in the comparative example.

When using the spark plug 9 mounting to an engine in the comparative example, as shown in FIG. 13A-FIG. 13C, a length of an electric discharge S differs according to a mounting position of the spark plug 9.

This relates with a direction of a gas flow F in a combustion chamber.

That is, when the spark plug 9 is mounted to the engine so that a standing portion 52 of an earth electrode 5 is disposed at the upstream side of a spark discharge gap 11 as shown in FIG. 13A, an electric discharge length L becomes very short.

On the other hand, as shown in FIG. 13B, when the spark plug 9 is mounted to the engine so that the position of the standing portion 52 of the earth electrode 5 to the spark discharge gap 11 is disposed in the position that intersects perpendicularly in the direction of the gas flow F, the electric discharge length L becomes very long.

Moreover, when the spark plug 9 is mounted to the engine so that the standing portion 52 of the earth electrode 5 is disposed at the downstream side of the spark discharge gap 11 as shown in FIG. 13C, although the electric discharge length L becomes longer to some extent, it becomes shorter compared with the case shown in FIG. 13B.

In addition, the electric discharge length L is defined here as the length of the electric discharge in the direction that intersects perpendicularly to the axial direction of the spark plug.

The electric discharge length L is information acquired by measuring the electric discharge length L of the electric discharge S occurring at the spark discharge gap 11 when the flow velocity of the gas flow F is configured to 15 m/s.

Figure 14:
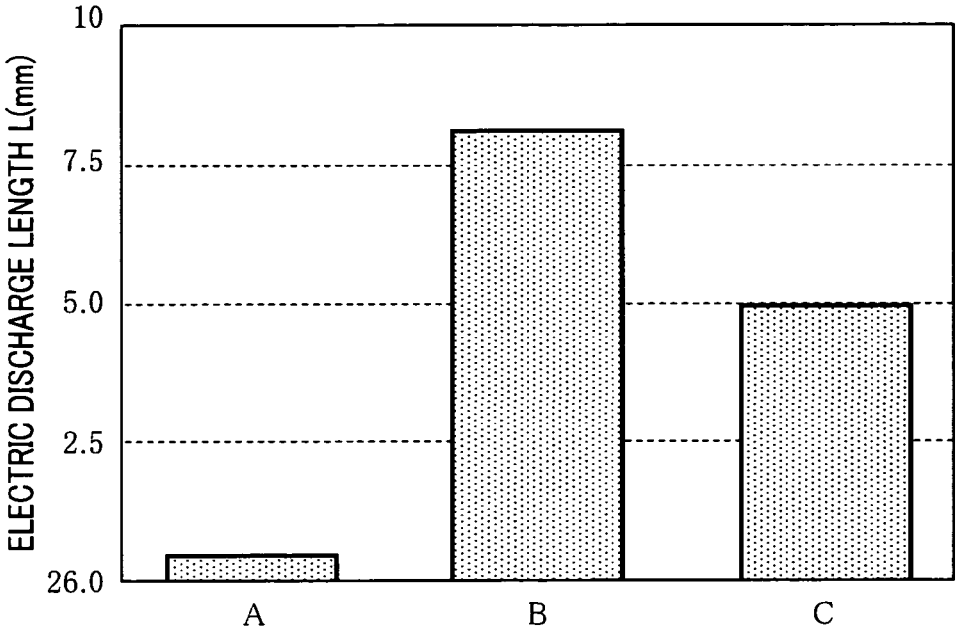
FIG. 14 shows a comparison graph of an electric discharge length in the comparative example.

Specifically, a big difference arises in the electric discharge length L according to the mounting position of each spark plug 9, as shown in FIG. 14.

A, B, and C in FIG. 14 express the data in the mounting position shown in FIGS. 13A, 13B, and 13C, respectively.

Figure 15:
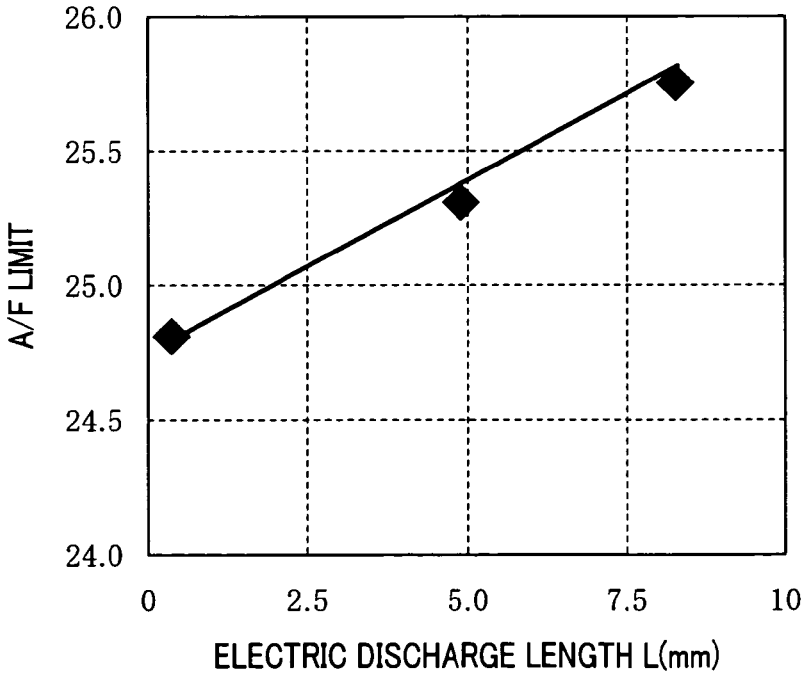
FIG. 15 shows a diagram of a relation of the electric discharge length and an A/F (air/fuel) limit in the comparative example.

Moreover, regarding a relation between the electric discharge length L and the ignition performance of the spark plug 9, it is confirmed that longer the electric discharge length L, the more the ignition performance improves, as shown in FIG. 15.

Here, the ignition performance is evaluated by an A/F limit, i.e., fuel limits of an air/fuel ratio that can ignite fuel-air mixture, thus the larger the A/F limit (fuel-air mixture is lean), the higher the ignition performance.

As known from FIG. 14 and FIG. 15, the ignition performance of the spark plug 9 in the comparative example change sharply according to the mounting position in the engine.

Operative Example

Figure 16:
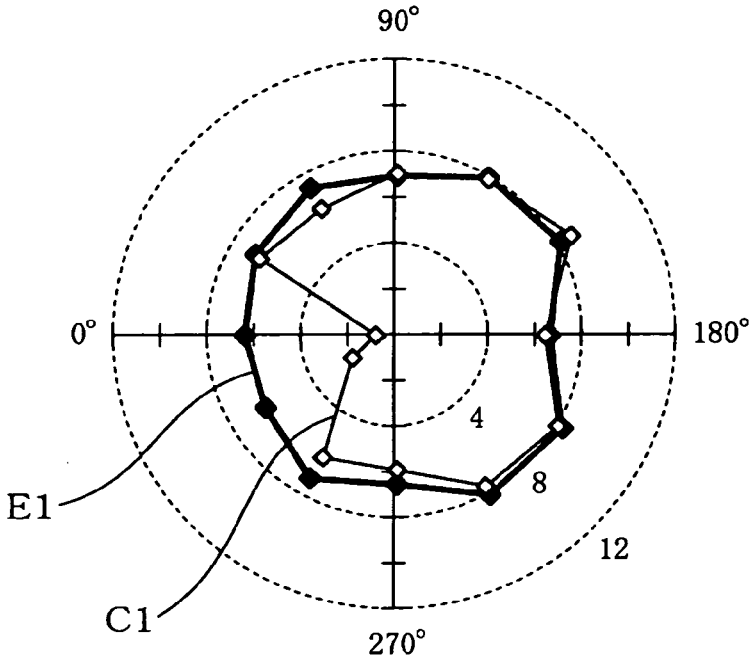
FIG. 16 shows a diagram of a relation between a mounting position of the spark plug with a 15 m/s flow velocity and the electric discharge length in the operative example.
Figure 17:
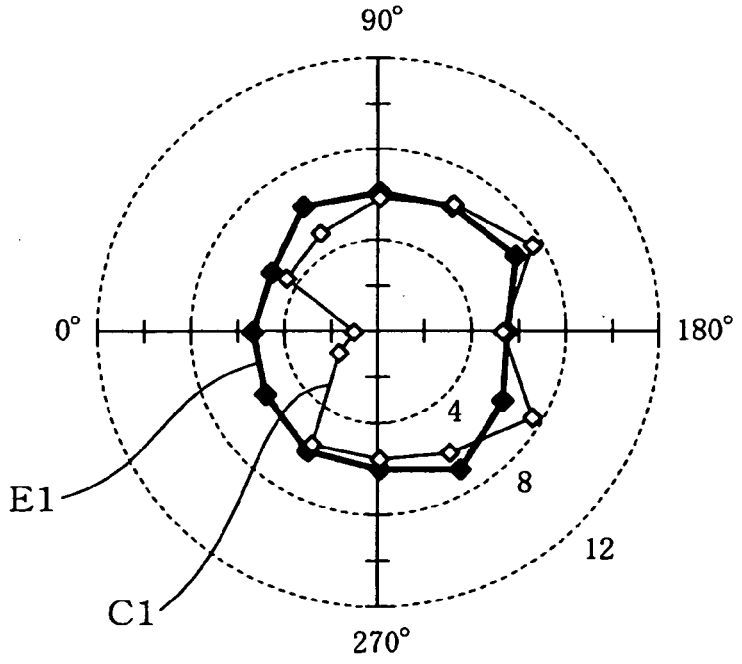
FIG. 17 shows a diagram of a relation between the mounting position of the spark plug with a 10 m/s flow velocity and the electric discharge length in the operative example.
Figure 18:
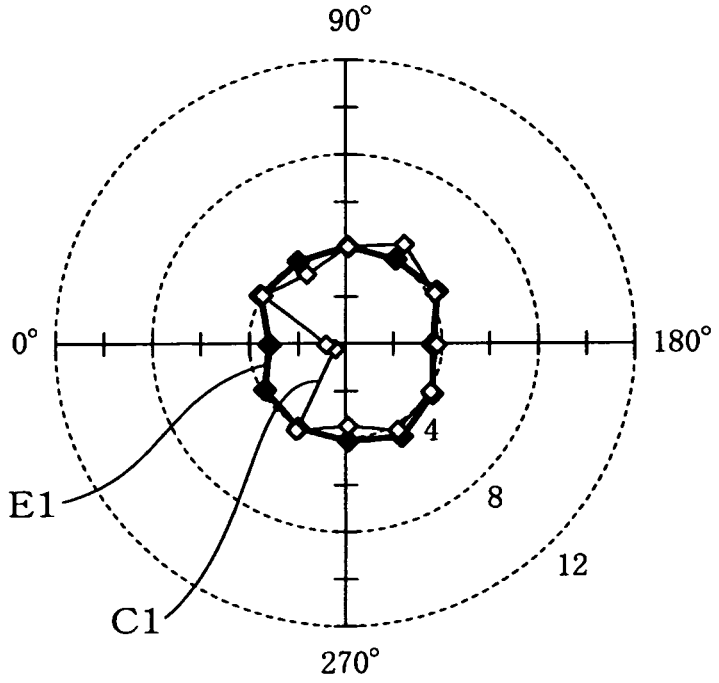
FIG. 18 shows a diagram of a relation between the mounting position of the spark plug with a 5 m/s flow velocity and the electric discharge length in the operative example.

The operative example shows an investigation of how each electric discharge length L changes with the positions of the standing portion 52 of the earth electrode 5 to the gas flow F using the spark plug 1 of the first embodiment and the spark plug 9 of the comparative example, as shown in the FIG. 16-FIG. 18.

Specifically, when a spark plug is seen from its tip in an axial direction, an angle α formed between a direction of the upstream of the gas flow F and the disposing position of the standing portion 52 of the earth electrode 5 to the spark discharge gap 11 is changed at intervals of 30 degrees from 0 to 330 degrees, and the electric discharge length L in each state is measured.

That is, when the angle α is 0 degree, the standing portion 52 of the earth electrode 5 is disposed at the upstream side of the spark discharge gap 11, and when the angle α is 180 degrees, the standing portion 52 of the earth electrode 5 is disposed at the downstream side of the spark discharge gap 11.

For each of the spark plug 1 of the first embodiment and the spark plug 9 of the comparative example, the electric discharge length L is measured changing the mounting position, as mentioned above, at the flow velocity of the gas flow of 15 m/s, 10 m/s, and 5 m/s.

The results are shown in FIG. 16-FIG. 18. FIG. 16 shows the test result of the flow velocity at 15 m/s, FIG. 17 is for the flow velocity at 10 m/s, and FIG. 18 is for the flow velocity 5 m/s.

Moreover, in each figure, a polygonal line with a reference mark E1 is a measurement result regarding the spark plug 1 of the first embodiment, and a polygonal line with a reference mark C1 is a measurement result regarding the spark plug 9 of the comparative example.

Moreover, in the same figures, the electric discharge length L is determined by a radial distance of a spark path from a vertical axis.

Further, the three concentric circles labeled 4, 8 and 12 in the figure drawn with dashed lines express the electric discharge length L, and the unit is mm.

As shown in FIG. 16-FIG. 18, even in any flow velocity, the polygonal line of the graph C1, which shows the electric discharge length L in the spark plug 9 of the comparative example, has a distorted shape.

This means that the length L of the electric discharge of the spark plug 9 in the comparative example changes sharply due to the mounting position.

Especially, it can be read that the electric discharge length L is very short in the portion where the angle α is 0 degree.

That is, when the standing portion 52 of the earth electrode 5 is disposed at the upstream side of the gas flow F relative to the spark discharge gap 11, the electric discharge length L becomes extremely short, and there is a possibility that the ignition performance may fall greatly.

On the other hand, the polygonal line of the graph E1, which shows the electric discharge length L in the spark plug 1 of the first embodiment, has an almost perfect near circular shape with a center at the origin.

This means that the sufficient electric discharge length L is securable without restricting the mounting position of the spark plug 1.

Therefore, the spark plug 1 of the first embodiment can secure ignition performance without restricting the mounting position.

What is claimed is:

1. A spark plug for internal-combustion engines comprising:

a cylindrical housing;

a cylindrical insulator held inside the housing;

a center electrode held inside the insulator so that a tip part of the center electrode project outwardly; and an earth electrode connected to the housing that forms a spark discharge gap between itself and the center electrodes; wherein, a gas guiding section is formed in a circumferential direction within a 90-degree range measured relative to a center of the earth joint section, which is a junction of the housing and the earth electrode in the circumferential direction at the housing; and the gas guiding section is including a slope that inclines toward a central axis from a circumference surface of the housing and at least one guide surface that has side wall parts continuously formed on both sides of the slope.

2. The spark plug for the internal-combustion engines according to claim 1, wherein, the gas guiding section is projected into a combustion chamber when the spark plug is mounted to the engines.

3. The spark plug for the internal-combustion engines according to claim 1, wherein, the gas guiding section is formed in a position adjoining the earth joint section.

4. The spark plug for the internal-combustion engines according to claim 1, wherein, the gas guiding section is formed in the circumferential direction within a 45-degree range measured relative to the center of the earth joint section in the circumferential direction.

5. The spark plug for the internal-combustion engines according to claim 1, wherein, the gas guiding section is formed on both sides in the circumferential direction of the earth joint section.

6. The spark plug for the internal-combustion engines according to claim 1, wherein, the gas guiding section is formed by projecting a part of the housing outward from its tip side.

7. The spark plug for the internal-combustion engines according to claim 1, wherein, a tip of the gas guiding section is disposed away from the tip of the insulator and towards the base end side.

8. The spark plug for the internal-combustion engines according to claim 7, wherein, the tip of the gas guiding section is disposed 0.5 mm or more away from the tip of the insulator and towards the base end side.

* * * * *